US008223079B2

(12) United States Patent
Noro et al.

(10) Patent No.: US 8,223,079 B2
(45) Date of Patent: Jul. 17, 2012

(54) ANTENNA WITH A METALLIC HOLDER DISPOSED BETWEEN AN ANTENNA ELEMENT AND A CIRCUIT BOARD

(75) Inventors: Junichi Noro, Tokyo (JP); Kyuichi Sato, Tokyo (JP); Hisashi Takisawa, Tokyo (JP); Toshiaki Aizawa, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 344 days.

(21) Appl. No.: 12/577,881

(22) Filed: Oct. 13, 2009

(65) Prior Publication Data

US 2010/0117912 A1 May 13, 2010

(30) Foreign Application Priority Data

Nov. 11, 2008 (JP) ..... 2008-288848

(51) Int. Cl.
*H01Q 1/32* (2006.01)

(52) U.S. Cl. ..... 343/713; 343/711; 343/712; 343/715; 343/872

(58) Field of Classification Search ..... 343/712, 343/713, 841, 872, 711, 715
See application file for complete search history.

(56) References Cited

U.S. PATENT DOCUMENTS

| | | | | |
|---|---|---|---|---|
| 6,600,103 | B1 | 7/2003 | Schmidt et al. | |
| 6,888,503 | B2 | 5/2005 | Shikata | |
| 6,909,405 | B2 | 6/2005 | Kondo | |
| 7,212,166 | B2 * | 5/2007 | Tseng et al. | 343/702 |
| 7,365,694 | B2 | 4/2008 | Inaba et al. | |
| 7,710,334 | B2 | 5/2010 | Noro et al. | |
| 2006/0202905 | A1 * | 9/2006 | Inaba et al. | 343/882 |

FOREIGN PATENT DOCUMENTS

| | | | |
|---|---|---|---|
| JP | 9-046118 | A | 2/1997 |
| JP | 11-074715 | A | 3/1999 |
| JP | 2000-114857 | A | 4/2000 |
| JP | 2002-539600 | T | 11/2002 |
| JP | 2003-215233 | A | 7/2003 |
| JP | 2004-088444 | A | 3/2004 |
| JP | 2006-237813 | A | 9/2006 |
| JP | 2007-013857 | A | 1/2007 |
| JP | 2008-061175 | A | 3/2008 |

OTHER PUBLICATIONS

Japanese Office Action dated Aug. 11, 2010 and English translation thereof, issued in counterpart Japanese Application No. 2008-288848.

* cited by examiner

*Primary Examiner* — Dieu H Duong
(74) *Attorney, Agent, or Firm* — Holtz, Holtz, Goodman & Chick P.C.

(57) ABSTRACT

An antenna device includes an antenna, the antenna including an antenna element, a circuit board, and a planar metallic holder disposed between the antenna element and the circuit board. The antenna device further includes an antenna case accommodating the antenna, and the antenna case include a top cover and a bottom plate serving as a base. The metallic holder supports the antenna element on the base, and includes a flat-shaped portion mounting a bottom surface of the antenna element and a plurality of tabs extending upwards from peripheral edges of the flat-shaped portion. The plurality of tabs includes a pair of front tabs and a pair of rear tabs, and a distance between the pair of front tabs is shorter than a distance between the pair of rear tabs.

6 Claims, 4 Drawing Sheets

ANTENNA WITH A METALLIC HOLDER DISPOSED BETWEEN AN ANTENNA ELEMENT AND A CIRCUIT BOARD

This application is based upon and claims the benefit of priority from Japanese patent application No. 2008-288848, filed on Nov. 11, 2008, the disclosure of which is incorporated herein in its entirety by reference.

BACKGROUND OF THE INVENTION

This invention relates to an antenna device and, in particular, to an antenna device for being used by mounting it on a roof of a mobile unit (a car body) such as an automobile and to an antenna for use in the same. Such an antenna device is, for example, an antenna device for use in a digital radio receiver for receiving a radio wave from an artificial satellite (that may be also called a "satellite wave" hereinafter) or a radio wave on a ground station (that may be also called a "terrestrial wave" hereinafter) to listen to a digital radio broadcasting.

In recent years, a digital radio receiver, which receives the satellite wave or the terrestrial wave so as to listen to the digital radio broadcasting, has been developed and is put to practical use in the United States of America. Specifically, two broadcasting stations called XM and Sirius provide radio programs on 250 or more channels in total. The digital radio receiver is generally mounted on a mobile unit such as an automobile and is adapted to receive a radio wave having a frequency of about 2.3 gigahertz (GHz) as a received wave to listen to the digital radio broadcasting. In other words, the digital radio receiver is a radio receiver capable of listening to mobile broadcasting. Inasmuch as the received wave has the frequency of about 2.3 GHz, a reception wavelength (resonance frequency) A thereof is equal to about 128.3 mm. It is noted here that the terrestrial wave is a radio wave obtained by receiving the satellite wave at a ground station, slightly shifting the frequency of the satellite wave, and retransmitting the linear polarized wave. Thus, the terrestrial wave is the linear polarized wave exhibiting linear polarization while the satellite wave is a circular polarized wave exhibiting circular polarization.

An XM satellite radio antenna apparatus normally serves to receive circular polarized radio waves from two stationary satellites and, in an insensitive zone of the circular polarized waves, receives a radio wave by using a terrestrial linear polarization portion of the radio antenna apparatus. On the other hand, a Sirius satellite radio antenna apparatus normally serves to receive circular polarized radio waves from three orbiting satellites (synchronous type) and, in the insensitive zone, receives a radio wave by a terrestrial linear polarization portion of the radio antenna apparatus.

As described above, the radio wave having the frequency of about 2.3 GHz is used in the digital radio broadcasting. Therefore, an antenna for receiving the radio wave is often located outside as known in the art. If the digital radio receiver is mounted in the mobile unit such as the automobile, the antenna device is generally attached to a roof of the mobile unit (car body).

The antenna device comprises an antenna and an antenna case for covering the antenna. The antenna case comprises a dome-like top cover and a bottom plate (a base). The antenna comprises an antenna element, a circuit board, and a shield case. For example, the antenna element may comprise a patch antenna for receiving the satellite antenna. The antenna element and the circuit board are directly connected to each other through a double-faced tape. The circuit board has a rear surface on which a circuit (hereinafter will be called a signal processing circuit) for performing various kinds of signal processing, such as signal amplification, upon a signal received by the antenna element is formed (mounted). The shield case serves to shield the signal processing circuit.

In such an antenna device mounted on the mobile unit, a mechanism (unit fixing member) for fixing the antenna device to the roof of the mobile unit (car body) must be formed by a component inside the antenna device. In addition, inasmuch as the antenna must be disposed inside the antenna case, another component (antenna fixing member) for fixing the antenna to the bottom plate is required also.

U.S. Pat. No. 7,365,694, which will be called Patent Document 1 hereinafter, discloses an antenna unit provided with a unit fixing member disposed between an antenna and a bottom plate. The unit fixing member is adapted to provisionally fix the antenna unit onto a mobile unit and to fix the antenna onto the bottom plate. In Patent Document 1, a shield case has a plurality of tabs for mounting the antenna to the bottom plate.

In the antenna device disclosed in Patent Document 1, the unit fixing member which is complicated in structure and is thick is disposed between the antenna and the bottom plate. Accordingly, on covering the antenna with a top caver, the height of the antenna device becomes high as a whole.

In addition, inasmuch as the antenna device is mounted on the roof of the mobile unit (car body), vibrations and impact of the mobile unit are delivered to the antenna accommodated in the antenna device (antenna case). In addition, the antenna is also subjected to acceleration and deceleration of the mobile unit in the direction of travel. That is, the antenna device is used in a hostile environment. In the manner which is described above, in a conventional antenna, the antenna element and the circuit board are directly connected to each other. In other words, the antenna element is only mounted (fixed) on the circuit board and is never supported to the bottom plate (base). Accordingly, in the conventional antenna, stress subjected to the vibrations and impact of the mobile unit or the acceleration and deceleration is exerted to the antenna element in itself, Specifically, in a case where soft material such as Teflon (registered trademark) is uses as a material of a high-frequency board making up the antenna element, the antenna element becomes deformed when the above-mentioned stress is exerted thereto. This is because the antenna element itself is never supported on the base.

SUMMARY OF THE INVENTION

It is therefore an object of the present invention to provide an antenna which has a high vibration proof and a high impact-resistant.

It is another object of the present invention to provide an antenna device which is capable of lowering a height thereof.

Other objects of this invention will become clear as the description proceeds.

According to a first aspect of this invention, an antenna comprises an antenna element, a circuit board, and a planar metallic holder disposed between the antenna element and the circuit board. The metallic holder supports the antenna element on a base.

DESCRIPTION OF THE PREFERRED EMBODIMENT

Referring to FIGS. 1, 2A, 2B, 2C, 2D, 2E, 2F, 3, 4, and 5, the description will proceed to an antenna device 10 according to an exemplary embodiment of the present invention and an antenna 20 accommodated therein.

Figure 1:
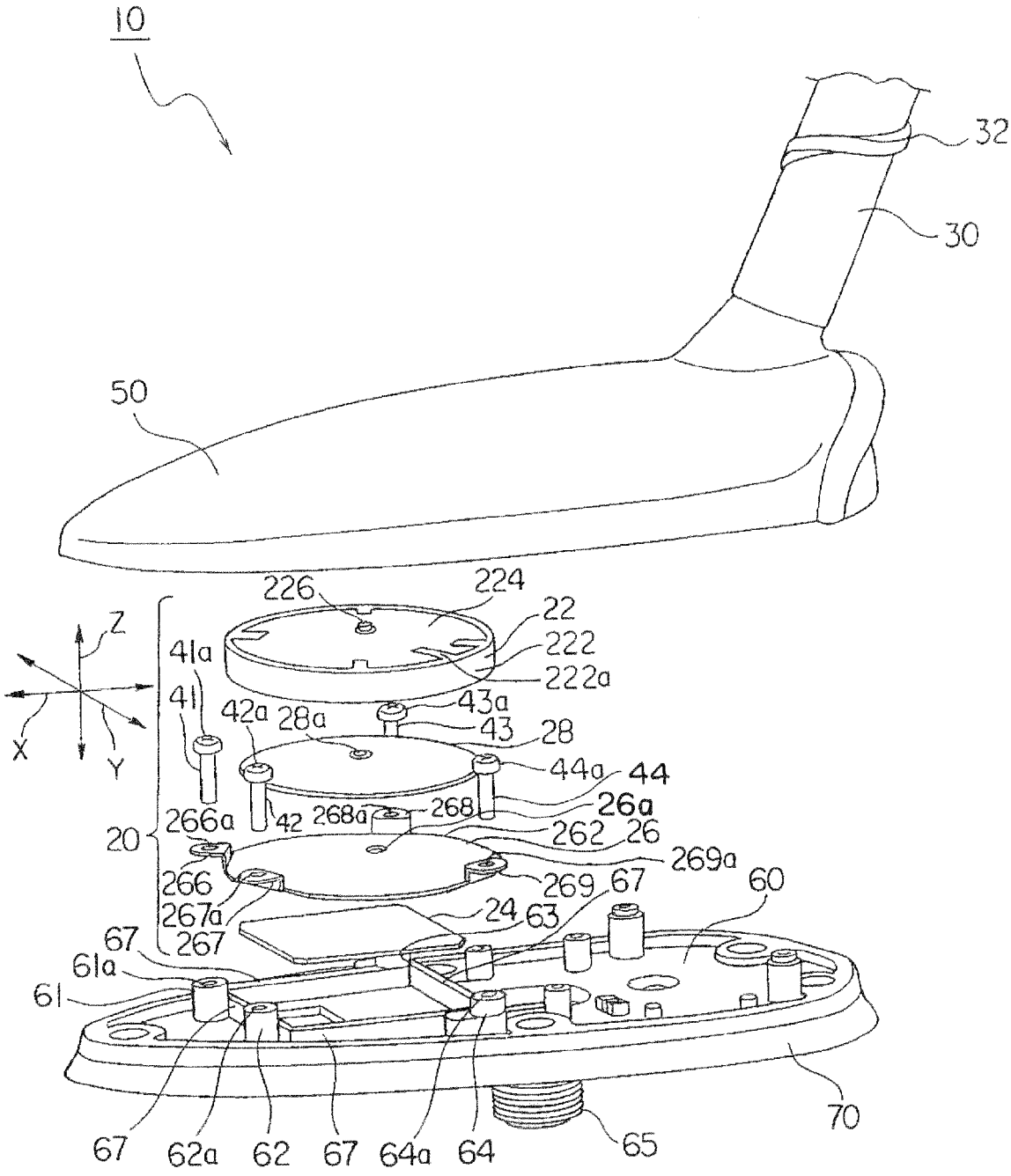
FIG. 1 is an exploded perspective view of an antenna device according to an exemplary embodiment of this invention.
Figure 2F:
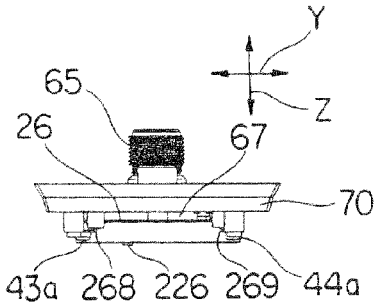
FIG. 2F is a rear view of the antenna device.
Figures 2A, 2C, 2D, 2E:
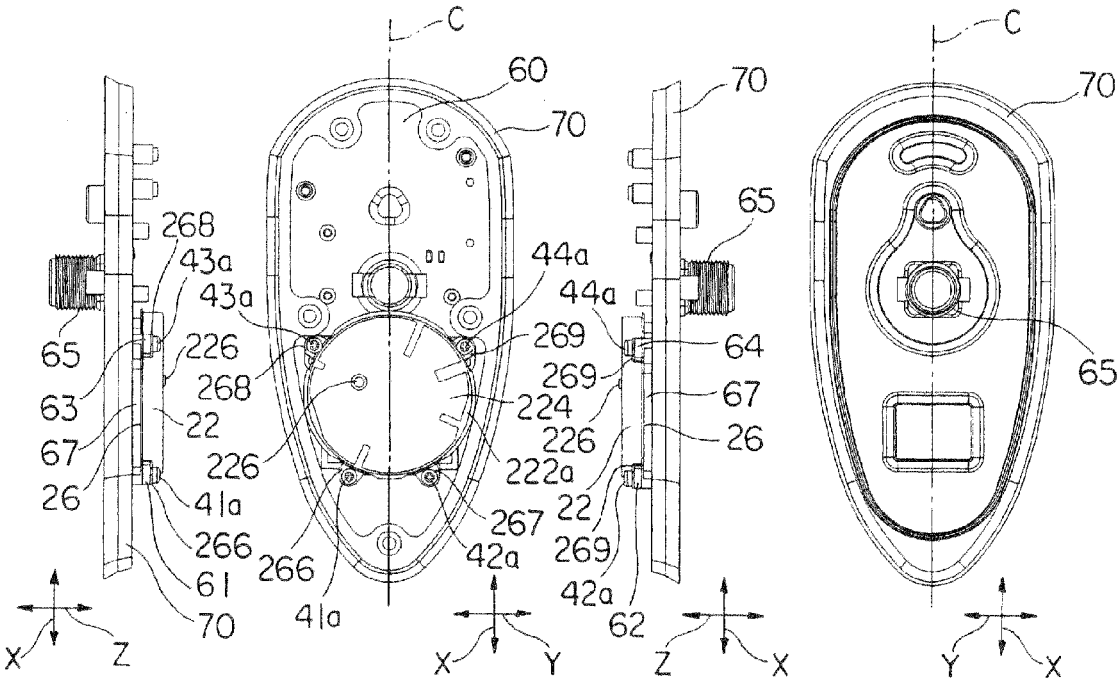
FIG. 2A is a plan view (top view) of the antenna device illustrated in FIG. 1 with a top cover removed.
FIG. 2C is a left side view of the antenna device.
FIG. 2D is a right side view of the antenna device.
FIG. 2E is a bottom view of the antenna device.
Figure 2B:
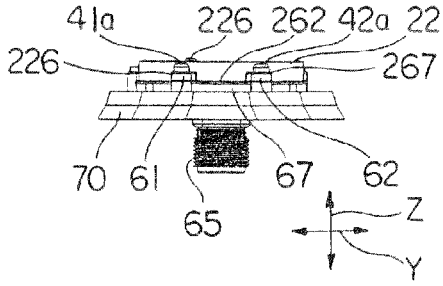
FIG. 2B is a front view of the antenna device.
Figure 3:
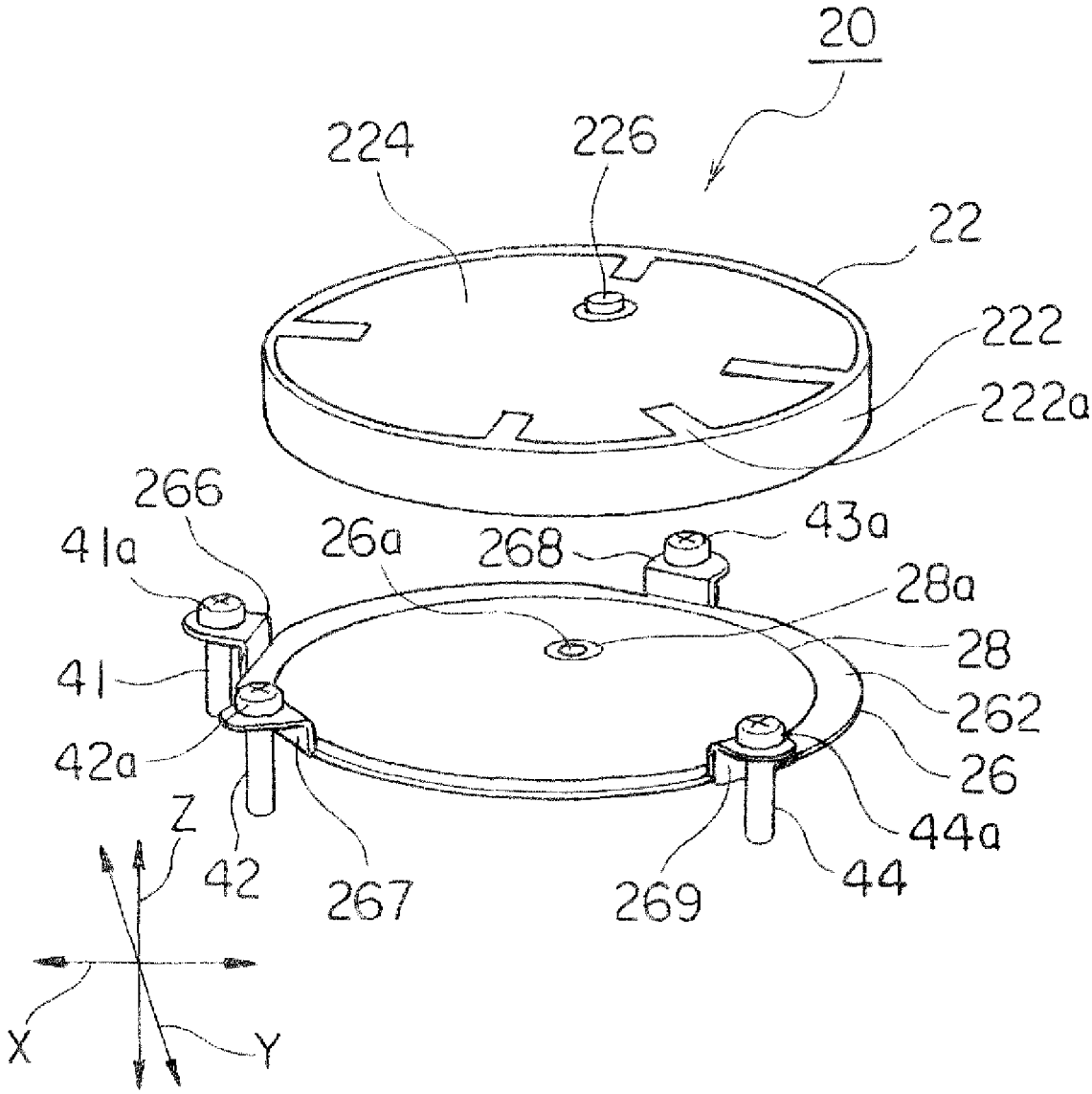
FIG. 3 is an exploded perspective view of an antenna accommodated in the antenna device illustrated in FIG. 1.
Figure 4:
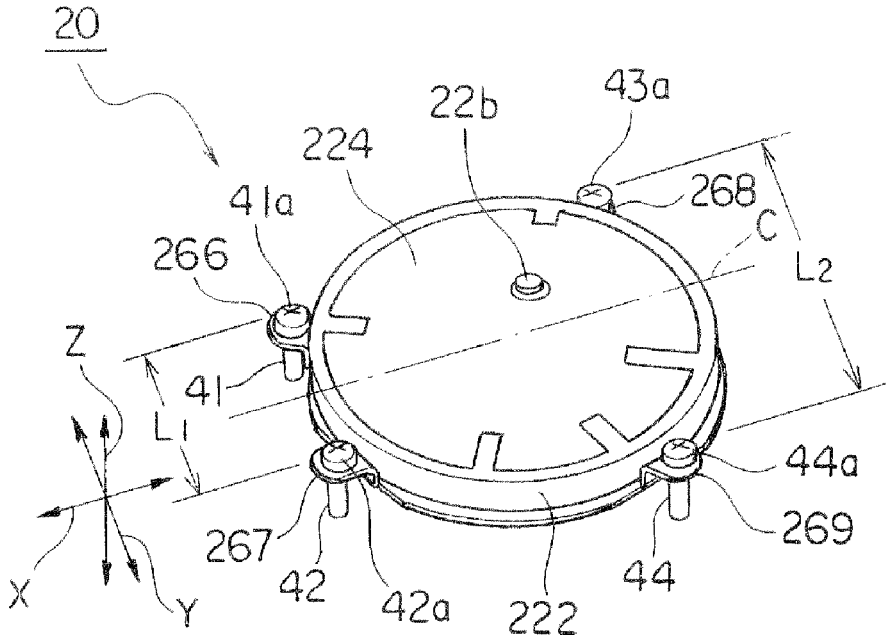
FIG. 4 is an assembled perspective view of the antenna illustrated in FIG. 3 as seeing it from a slanting direction on high.
Figure 5:
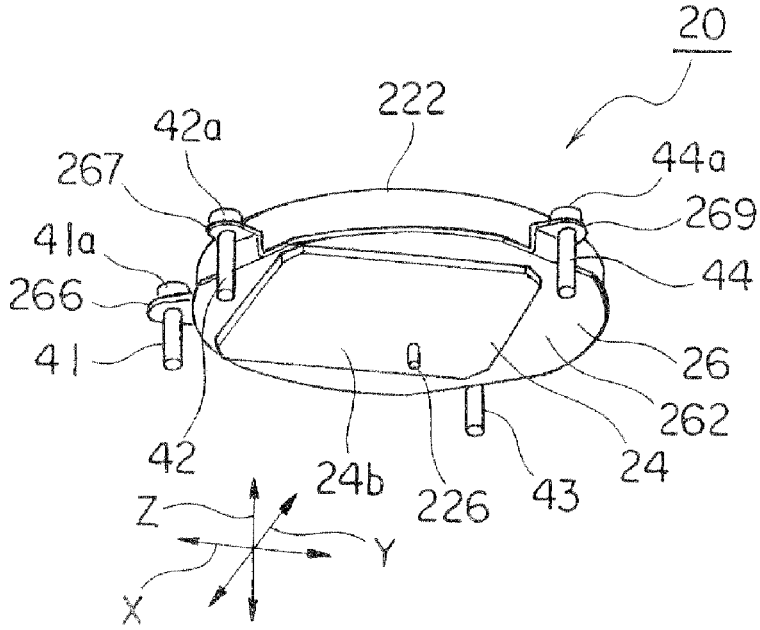
FIG. 5 is an assembled perspective view of the antenna illustrated in FIG. 3 as seeing it from a slanting direction on low.

FIG. 1 is an exploded perspective view of the antenna device 10. FIGS. 2A through 2F are views showing the antenna device 10 with a top cover removed. FIG. 2A is a plan view (top view) of the antenna device 10. FIG. 2B is a front view of the antenna device 10. FIG. 2C is a left side view of the antenna device 10. FIG. 2D is a right side view of the antenna device 10. FIG. 2E is a bottom view of the antenna device 10. FIG. 2F is a rear view of the antenna device 10. FIG. 3 is an exploded perspective view of the antenna 20 accommodated in the antenna device 10. FIG. 4 is an assembled perspective view of the antenna 20 as seeing it from a slanting direction on high. FIG. 5 is an assembled perspective view of the antenna 20 as seeing it from a slanting direction on low.

The illustrated antenna device 10 is an antenna apparatus for use in a digital radio receiver and is used by attaching to a roof of a mobile unit (car body) such as an automobile.

Herein, in the manner shown in FIGS. 1 to 5, an orthogonal coordinate system (X, Y, Z) is used. In a state illustrated in FIGS. 1 to 5, in the orthogonal coordinate system (X, Y, Z), an X-axis direction is a fore-and-aft direction (a traveling direction), a Y-axis direction is a left-and-right direction, and a Z-axis direction is an up-and-down direction (a height direction).

The illustrated antenna device 10 comprises the antenna 20 and an antenna case (which will later be described) for covering the antenna 20. The antenna case comprises a dome-like top cover 50 and a bottom plate (base) 60. The antenna 20 is accommodated in the top cover 50. The illustrated bottom plate (base) 60 is made of an aluminum die casting.

In addition, in the illustrated antenna device 10, the top cover 50 is equipped with a rod antenna 30. The rod antenna 30 is for receiving radio waves of AM/FM radio or a telephone band. The rod antenna 30 is disposed inclined in a slanting direction backwards with respect to a vertical line (the up-and-down direction) Z. The rod antenna 30 has an outer surface around which a wind noise preventing member 32 is placed.

The bottom plate (base) 60 has a lower surface which is covered with a base pad 70. The bottom plate 60 has, at a lower portion, a mounting boss 65 for mounting it to a roof panel of the automobile. The boss 65 has an outer surface on which an external thread is formed.

The antenna 20 comprises an antenna element 20 and a circuit board 24. Between the antenna element 20 and the circuit board 24, a planar metallic holder 26 is inserted. The metallic holder 26 is for supporting the antenna element 22 on the base (the bottom plate) 60. The metallic holder 26 and the antenna element 22 are adhesively fixed to each other via a double-sided adhesive tape 28.

The illustrated antenna element 22 comprises a patch antenna for receiving a satellite wave. The circuit board 24 has a rear surface 24*b* on which an electric circuit (hereinafter called a signal processing circuit) is formed. The signal processing circuit is for performing various kinds of signal processing, such as signal amplification, upon a received signal received by the antenna element 22. The signal processing circuit includes a low noise amplifying circuit (LNA).

The illustrated antenna element 22 comprises a cylindrical high-frequency board 222 having an upper surface 222*a* and a radiation element 224 formed on the upper surface 222*a* of the high-frequency board 222. Although illustration is not made, the high-frequency board 222 has a lower surface on which a ground pattern is formed. In addition, a feeding pin 226 penetrates the high-frequency board 222 at a position apart from a center thereof in the up-and-down direction Z.

In the manner as described above, inasmuch as the feeding pin 226 is provided at the position apart from the center of the antenna element 22, the antenna element 22 can receive a circular polarized wave.

The double-sided adhesive tape 28 has an opening portion 28*a* through which the feeding pin 226 passes and the metallic holder 26 has a though hole 26*a* through which the feeding pin 226 passes. The above-mentioned ground pattern has an opening portion through which the feeding pin 226 passes.

The feeding pin 226 has an upper end connected to the radiation element 224 by a solder (not shown). The feeding pin 226 has a lower end which penetrates up to the circuit board 24 via the opening portion of the ground pattern, the opening portion 28*a* of the double-sided adhesive tape 28, and the through hole 26*a* of the metallic holder 26. Accordingly, the feeding pin 226 is not electrically connected to the ground pattern and the metallic holder 26.

The illustrated high-frequency board 222 is made of an insulating material such as Teflon (registered trademark) which is a material of a good high-frequency characteristic or the like. Although Teflon (registered trademark) has the good high-frequency characteristic but is a soft material. As a result, when stress is exerted to it from outside, the high-frequency board 222 (the antenna element 22) becomes deformed. According to this invention, in order to prevent the antenna element 22 from directly exerting the stress, the high-frequency board 222 (the antenna element 22) is supported on the base (the bottom plate) 60 through the metallic holder 26.

The metallic holder 26 comprises a flat-shaped portion 262 mounting a bottom surface of the antenna element 22 and first through fourth tabs 266, 267, 268, and 269 which extend from ambient edges of the flat-shaped portion 262 upwards. The above-mentioned through hole 26*a* is bored in the flat-shaped portion 262. The flat-shaped portion 262 has an area which is slightly wider (larger) than that of the bottom surface of the antenna element 22.

As shown in FIGS. 4 and 5, each of the first through the fourth tabs 266 to 269 has a standing portion which is disposed so as to come into contact with an outer side wall of the high-frequency board 222. Accordingly, it is possible for the metallic holder 26 to support (hold) the antenna element 22 without position displacement with respect to the base (the bottom plate) 60. In other words, the first through the fourth tabs 266 to 269 of the metallic holder 26 also serve as a positioning arrangement for positioning the antenna element 22 on the base (the bottom plate) 60.

The first through the fourth tabs 266 to 269 are provided with first through fourth through holes 266*a*, 267*a*, 268*a*, and 269*a* for penetration of first through fourth screws 41, 42, 43, and 44, respectively.

As apparent from FIG. 5, the high-frequency board 222 has a thickness (height) which is not less than a size obtained by adding a height from the flat-shaped portion 262 to respective tabs 226 to 269 and a thickness of each head 41*a*, 42*a*, 43*a*, and 44*a* of the screws 41 to 44.

The bottom plate 60 has first through fourth bosses 61, 62, 63, and 64 provided with first through fourth screw holes 61*a*, 82*a*, 63*a*, and 64*a* to be engaged with the first through the fourth screws 41 to 44, respectively. Accordingly, the first through the fourth screws 41 to 44 are screwed to the first through the fourth bosses 61 to 64 via the first through the fourth through holes 266*a* to 269*a* of the first through the fourth tabs 266 to 269, respectively. In the manner which is described above, the antenna 20 is fixed to the bottom plate 60 using the first through the fourth screws 41 to 44. In this event, the heads 41*a* to 44*a* of the first through the fourth screws 41 to 44 never project from an upper surface of the antenna element 22 upwards. Accordingly, it is conducive to the shortening of the antenna device 10 on covering the top cover 50 to the antenna 20.

As shown in FIGS. 2A and 2E, the antenna device 10 has a center line C which extends in the fore-and-aft direction (the traveling direction) X of the mobile unit. The first through the fourth tabs 266 to 269 are substantially symmetrically placed with respect to the center line C (the fore-and-aft direction X).

Specifically, the first and the second tabs 266 and 267 are called a pair of front tabs because they are disposed forward of the mobile unit. On the other hand, the third and the fourth tabs 268 and 269 are called a pair of rear tabs because they are disposed rearward of the mobile unit.

As shown in FIG. 4, the pair of front tabs (266, 267) has a distance $L_1$ therebetween that is shorter than a distance $L_2$ between the pair of rear tabs (268, 269). As well known in the art, an automobile (the mobile unit) is accelerated or decelerated in the fore-and-aft direction (the traveling direction) X by pressing down on the accelerator or by stepping on the brake by a driver. As a result, the antenna 20 (the antenna element 22) also exerts the stress along the fore-and-aft direction X. In order to spread the stress out over, the metallic holder 26 is provided with the first through the fourth tabs 266 to 269. In addition, in order to improve shock resistance due to acceleration and deceleration of the automobile (the mobile unit) in the fore-and-aft direction, in the antenna device 10 according to the exemplary embodiment of this invention, the pair of front tabs (266, 267) provided to the metallic holder 26 is disposed inward (closer) in comparison with the pair of rear tabs (268, 269).

As shown in FIG. 1, the bottom plate 60 comprises a shielding wall 67 standing toward the circuit board 24 at a position corresponding to an outer edge of the circuit board 24 so as to enclose a rear surface 24*b* (see FIG. 5) of the circuit board 24. Accordingly, the illustrated antenna 20 negates the need for a shield case which is required to a conventional antenna. In other words, it is unnecessary to provide the shield case aside from the bottom plate 60.

In the antenna according to the first aspect of this invention, the metallic holder and the antenna element may be adhesively fixed to each other via a double-sided adhesive tape. The antenna element may comprise a high-frequency board having an upper surface, and a radiation element formed on the upper surface of the high-frequency board. The metallic holder may comprise a flat-shaped portion mounting a bottom surface of the antenna element, and a plurality of tabs which extend from ambient edges of the flat-shaped portion upwards. In this event, the tabs preferably may be provided with a plurality of through holes for penetration of a plurality of screws, respectively. The high-frequency board preferably may have a thickness which is not less than a size obtained by adding a height from the flat-shaped portion to the tabs and a thickness of each head of the screws.

According to a second aspect of this invention, an antenna device comprises the antenna and an antenna case accommodating the antenna. The antenna case comprises a top cover and a bottom plate serving as the base. The bottom plate has a plurality of bosses provided with screw holes to be engaged with the plurality of screws. The plurality of screws are screwed to the plurality of bosses via the plurality of through holes of the plurality of tabs, respectively.

In the antenna device according to the second aspect of this invention, the antenna device may be mounted on a roof of a mobile unit. The plurality of tabs may be equal in number to four. The four tabs desirably may be substantially symmetrically placed with respect to a center line which extends in a fore-and-aft direction of the mobile unit. The four tabs may comprise a pair of front tabs disposed forward of the mobile unit and a pair of rear tabs disposed rearward of the mobile unit, In this event, the pair of front tabs preferably may have a distance therebetween that is shorter than a distance between the pair of rear tabs. The bottom plate may be made of a die casting. In this event, the bottom plate desirably may comprise a shielding wall standing toward the circuit board at a position corresponding to an outer edge of the circuit board so as to enclose a rear surface of the circuit board.

While this invention has thus far been described in conjunction with the preferred embodiment thereof, it will readily be possible for those skilled in the art to put this invention into practice various other manners. For example, the shape of the antenna element is not limited to the cylinder and may be a quadrilateral pillar or a polygonal pillar. In addition, it will readily be understood that the number of the bosses formed on the bottom plate and the number of the tabs formed on the metallic holder are not limited to those mentioned in the foregoing embodiment.

In addition, although the antenna unit described in the foregoing embodiment is suitable for the antenna device for use in the digital radio receiver, the antenna unit according to this invention may not be restricted to this and may be applicable to an antenna unit for use in a GPS receiver or antenna units for use in mobile communications for receiving other satellite waves and other terrestrial waves, and so on.

What is claimed is:

1. An antenna device comprising:

an antenna comprising an antenna element, a circuit board, and a planar metallic holder disposed between said antenna element and said circuit board, said metallic holder supporting said antenna element on a base; and an antenna case accommodating said antenna, said antenna case comprising a top cover and a bottom plate serving as said base;

wherein said metallic holder comprises:

a flat-shaped portion mounting a bottom surface of said antenna element; and a plurality of tabs which extend upwards from peripheral edges of said flat-shaped portion, said tabs being provided with a plurality of through holes through which a plurality of screws are respectively penetrable;

wherein said plurality of tabs comprises a pair of front tabs disposed forward of said mobile unit and a pair of rear tabs disposed rearward of said mobile unit, and wherein a distance between said pair of front tabs is shorter than a distance between said pair of rear tabs;

wherein said bottom plate has a plurality of bosses provided with screw holes which are engageable with the plurality of screws, the plurality of screws being engageable with the plurality of bosses via respective ones of the plurality of through holes of the plurality of tabs; and wherein said antenna device is mounted on a roof of a mobile unit.

2. The antenna device according to claim 1, wherein said metallic holder and said antenna element are adhesively fixed to each other via a double-sided adhesive tape.

3. The antenna device according to claim 1, wherein said antenna element comprises:

a high-frequency board having an upper surface; and a radiation element formed on the upper surface of said high-frequency board.

4. The antenna device according to claim 3, wherein said high-frequency board has a thickness which is not less than a size obtained by adding a height from said flat-shaped portion to said tabs and a thickness of each head of said plurality of screws.

5. The antenna device according to claim 1, wherein the plurality of tabs are equal in number to four, wherein the four tabs are substantially symmetrically placed with respect to a center line which extends in a fore-and-aft direction of said mobile unit.

6. The antenna device according to claim 1, wherein said bottom plate is made of a die casting, and wherein said bottom plate comprises a shielding wall which extends toward said circuit board at a position corresponding to an outer edge of said circuit board so as to enclose a rear surface of said circuit board.

* * * * *